US006365851B1

(12) United States Patent
Gasper

(10) Patent No.: US 6,365,851 B1
(45) Date of Patent: Apr. 2, 2002

(54) ELECTRICAL SWITCH EXTRACTION HANDLE WITH LOCKOUT

(75) Inventor: Thomas Gasper, Cambridge, MD (US)

(73) Assignee: Airpax Corporation, L.L.C., Frederick, MD (US)

( * ) Notice: Subject to any disclaimer, the term of this patent is extended or adjusted under 35 U.S.C. 154(b) by 0 days.

(21) Appl. No.: 09/846,702

(22) Filed: Apr. 30, 2001

(51) Int. Cl.[7] ..... H01H 9/02

(52) U.S. Cl. ..... 200/43.14; 200/43.16; 200/50.02

(58) Field of Search ..... 200/43.01, 43.11, 200/43.14–43.17, 50.01, 50.02, 50.11, 318, 321, 322, 334

(56) References Cited

U.S. PATENT DOCUMENTS 3,291,924 A * 12/1966 Tharp ..... 200/42
4,978,816 A * 12/1990 Castonguay et al. ..... 200/43.14
5,412,167 A * 5/1995 Mueller et al. ..... 200/43.14
6,015,956 A * 1/2000 Green ..... 200/43.14
6,137,068 A * 10/2000 Padulo ..... 200/43.16

* cited by examiner

*Primary Examiner*—Michael Friedhofer
(74) *Attorney, Agent, or Firm*—Milde & Hoffberg LLP

(57) ABSTRACT

A switch, having a mechanical user interface including a lever handle and an electrical socket interface including a set of contacts separable upon application of tension. The switch includes a handle guard and an extraction tool, adapted to apply sufficient tension to the switch to separate the contacts from the electrical socket, wherein the extraction tool has a first position and a second position, said extraction tool being adapted, upon application of tension when in said first position, to move the lever handle of the switch from an active to an inactive position before assuming said second position, and upon application of tension when in said second position to separate the set of contacts from the electrical socket.

15 Claims, 6 Drawing Sheets

ELECTRICAL SWITCH EXTRACTION HANDLE WITH LOCKOUT

FIELD OF THE INVENTION

The present invention relates to the field of manually actuable switch handle guards.

BACKGROUND OF THE INVENTION

A number of designs are available to prevent accidental or inadvertent manipulation of a switch, and to discourage tampering therewith. Typically, these designs include a cover or pseudocover over the normal switch cover. Other systems provide a recessed handle or require a tool for use.

Likewise, it is known to provide modular or removable mechanical switches in electrical apparatus. An extraction tool may be used to remove the mechanical switch from its electrical socket or mounting.

SUMMARY OF THE INVENTION

The present invention provides a switch guard, advantageously combined with a switch extraction tool, such that the switch must be deactivated prior to removal from a circuit. The extraction tool thus is either inhibited by switch activation, or automatically deactivates the switch prior to releasing the switch.

The switch guard, for example, comprises removable covering portion, normally disposed to prevent manual actuation of the switch, in at least one operating position thereof. The cover, when removed, either automatically switches the position of the switch, or provides manual access to the switch handle. The switch guard advantageously also serves as an extraction tool for applying an extractive force on the switch, which would permit removal of a socketed switch. Preferably, the switch guard as extraction tool either automatically switches the switch into a desired position, or is impaired in providing the required extraction force if the switch is not in the desired position. Thus, the switch guard provides a safety feature.

According to a preferred embodiment, the switch guard, comprises a set of fulcrum pins rigidly mounted to the switch, about which a combination covering portion and extraction tool rotates. According to this embodiment, as the combination covering portion and extraction tool is rotated about the fulcrum pins, and displaced relatively apart from the body of the mechanical switch, a member of the combination covering portion and extraction tool exerts a force on the switch toggle, causing the switch to turn the OFF position, if it is not already in that state. When the combination covering portion and extraction tool is in the fully displaced apart from the body, it is particularly adapted as a manual handle to apply an extractive force on the fulcrum pins, and thereby apply the extractive force from the switch body away from an underlying socket.

Thus, the switch guard serves a first protective function to prevent accidental change in position of the switch, and further to prevent ready extraction of the switch.

Preferably, the fulcrum pins are disposed on a pair of walls which laterally protect the switch lever handle, which may be part of a manufactured switch, retrofit to a standard switch type, or provided as modular kit arrangement.

The combination covering portion and extraction tool may be provided with an aperture, allowing ready access to the toggle of the switch by a finger, for movement to the operating position, and/or to provide visual access to the switch toggle, for example to display a trip status.

When integral with the switch as manufactured, the switch toggle (lever handle) may be designed to efficiently interact with the extraction tool, and thus may have a cam surface or the like to facilitate smooth operation. On the other hand, when part of a modular kit or retrofit installation, the extraction tool operates against the normal manually operable toggle.

According to a preferred embodiment, the extraction tool comprises a manually graspable handle member and a pair of lateral recesses, cooperating with a pair of fulcrum pins to provide a pivoting structure. The handle is displaced from the lateral recess by an elongated member, which is, for example, a pair of arms. The normal position of the extraction tool is such that the extraction tool covers the switch lever. The extraction tool may have an open aperture, for example, a space between the pair of arms, which allow visual access to the switch toggle, for example. in order to permit visual examination of its position. In addition, the toggle may be displaced manually, if it is in an accessible position, by presenting a finger through the open aperture.

The extraction tool also comprises an actuation member, linked to the toggle at a position opposite from the manually graspable member with respect to the lateral recesses (i.e., the axis of rotation), such that when the extractor handle is withdrawn away from the mechanical switch body, the actuation member applies a force against the switch toggle. Preferably, the actuation member is rigidly linked to the extraction handle, such that movement of the extraction handle produces a corresponding movement in the actuation member, to displace the switch toggle, causing an alteration of the switch status, for example from "On" to "OFF". The actuation member preferably has a flat cam surface for pressing against the switch toggle. Further, this cam surface is preferably hollow, such that when the extraction handle is in its normal position, the switch toggle sits hidden beneath it.

The extraction handle may, for example, freely pivot between the normal and extended position, have a spring return, or a set of detents for retaining a desired position. Preferably, the extraction handle freely pivots, and is generally held in the normal position by the toggle, which is typically itself spring loaded. Thus, when in the normal position, with the switch activated, the actuation member rests against the switch toggle and is retained in the retracted position. After the switch is tripped or OFF, the extraction handle freely rotates to the extended position. To reactivate the switch, the toggle lever is returned to the normal (retracted) position, and a finger or tool inserted into the aperture between the arms of the extraction tool, to urge the toggle into the activated or ON position, thus retaining the extraction tool in the normal position, since the toggle then rests against the inner surface of the hollow portion.

In order to remove the mechanical switch, which is set in a socket providing electrical connections, a tensile force is applied to the extraction tool handle. This force initially deactivates the switch (or ensures that the switch is deactivated), by applying a force to the toggle, urging it into the OFF or deactivated position, or ensuring it is already in this position, and then, when the extraction tool handle is fully extended, transmits a tensile force to the fulcrum pins, switch guard, switch, and ultimately to the electrical socket. The electrical socket is held together by a combination of friction and elastic forces, and when these are overcome, the switch is removed from the socket.

The handle guard is, for example, integral with, or held to the switch body by screws or other type of fasteners or fastening means. Typical known switches are with fasteners for attaching a faceplate or the like, and thus in the case of a retrofit design, the fasteners may be standardized. Such fasteners may include screws, bolts, rivets, or the like. Alternately, the handle guard may be fastened to the switch by glue or other adhesive, or welded in place.

It is therefore an object of the invention to provide a switch extraction system which ensures that the switch is deactivated prior to permitting extraction of the switch.

It is a further object of the invention to provide a retrofit kit for a manually operable switch that provides an extraction tool for removing the switch from a socket, while ensuring that the switch is deactivated prior to removal.

It is a still further object of the invention to provide a switch guard having an extensible handle for unidirectionally altering a toggle or switch handle lever position, providing access for a second switch activation means for unidirectionally altering the switch handle lever in the opposite direction. This second switch activation means may be a human finger, tool, or a corresponding handle. Preferably, in the case of a dual handle embodiment, only one handle is operable to permit extraction of the mechanical switch from its socket.

It is also an object of the invention to provide a switch protector, for a switch having a lever having first and second states, comprising a switch guard, supporting a mounting proximate to the lever; and an extraction handle, having a first position and a second position, adapted for displaceably interlocking with the mounting, and for extracting the switch from a socket when in the second position; the extraction handle, mounted in the first position, blocking manual access to the lever in the first state, and when mounted and displaced from the first position to the second position, displacing the lever from the first position to the second position.

It is a further object of the invention to provide a switch, having a mechanical user interface and an electrical socket interface, the mechanical user interface comprising a lever handle and the electrical interface comprising a set of contacts separable upon application of a sufficient tensile force, the improvement comprising providing a handle guard, and an extraction tool, adapted to apply sufficient tensile force on the switch to separate the contacts from the electrical socket interface, wherein the extraction tool has a first position and a second position, the extraction tool being adapted, upon application of a tensile force when in the first position, to move the lever handle of the switch from an active to an inactive position before assuming the second position, and upon application of a sufficient tensile force when in the second position, to separate the set of contacts from the electrical socket interface.

It is a still further object of the invention to provide a retrofit kit for an electrical switch having an actuation lever, comprising an actuation lever guard, adapted for attachment to the electrical switch and being adapted to restrict manual access to the actuation lever; and an extraction tool, mounted on the actuation lever guard adapted to apply significant tension to the switch, e.g., sufficient to separate the electrical contacts of switch from an electrical socket, wherein the extraction tool has a first position and a second position, the extraction tool being adapted, upon application of tension when in the first position, to move the lever handle of the switch from an active to an inactive position before assuming the second position, and upon application of tension when in the second position to separate the set of contacts from the electrical socket.

It is another object of the invention to provide a method for removing a switch from a socket, comprising the steps of providing a switch, having a mechanical user interface and an electrical socket interface, the user interface comprising a lever handle and the electrical interface comprising a set of contacts separable upon application of tension; providing an extraction member, having first and second positions, adapted to apply sufficient tension to the switch to separate the contacts from the electrical socket, and being disposed to shift the lever handle from an active position to an inactive position when displaced from a first position to a second position; applying a first tension to the extraction member while in the first position to move the lever handle of the switch from the active to the inactive position; and applying a second tension, when the extraction member is in the second position, to separate the set of contacts from the electrical socket.

These and other objects will become apparent from a review of the drawings and description of the preferred embodiments.

BRIEF DESCRIPTION OF THE DRAWINGS

The preferred embodiments of the invention will now be described by way of the drawings, in which.

DETAILED DESCRIPTION OF THE PREFERRED EMBODIMENTS

Figure 1:
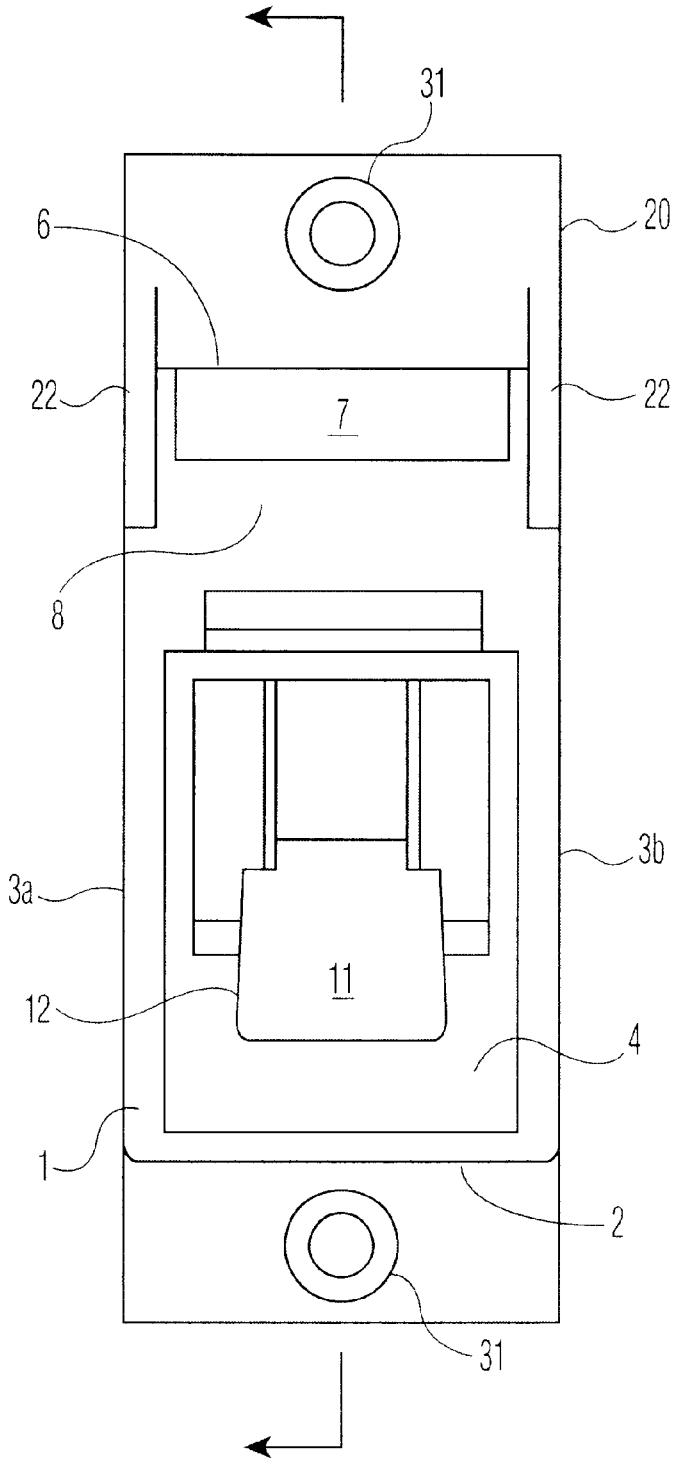
FIGS. 1 and 2 show, respectively a front and cut-away side view of a first embodiment of a switch guard according to the present invention.

The preferred embodiments will now be described by way of example, in which like reference numerals indicate like elements.

Figure 2:
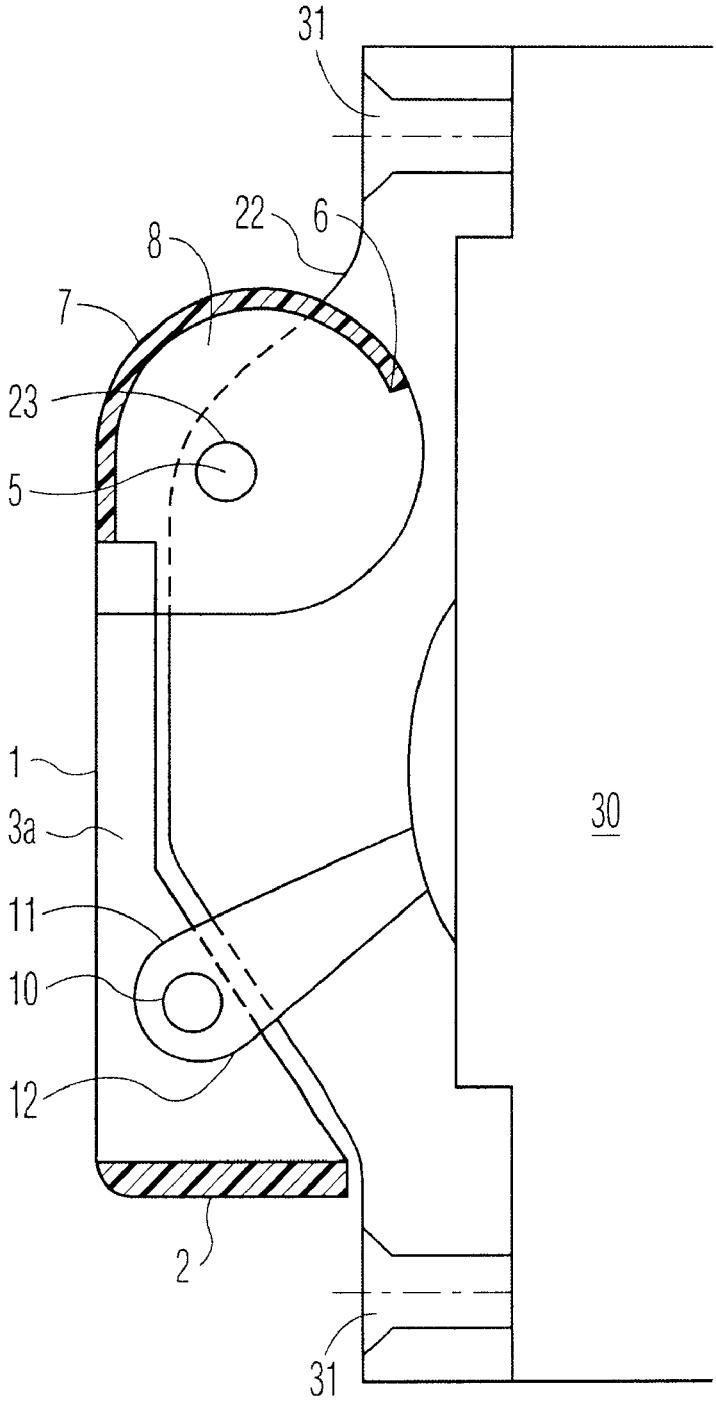

As shown in FIGS. 1 and 2, the extraction handle 1 of the preferred embodiment comprises a graspable handle portion 2, a pair of elongated side arms 3*a*, 3*b* supporting the handle portion 2, defining an aperture 4 therebetween, a pair of fulcrum pin recesses 5, about which the extraction handle 1 is adapted to rotate, and an actuation edge portion 6, having an upper cam surface 7 and a lower recess 8.

In a resting position with the switch 30 activated, the actuation portion 6 covers one side 11 of the switch handle lever 10. As the extraction handle 1 is pivoted about the fulcrum pin recesses 5, the edge portion 6 abuts the side 11 of the switch handle lever 10, displacing it about its axis of rotation, defined by the internal linkages within the switch 30, not shown in the figures. With further rotation, the switch lever handle 10 contacts the cam surface 7, gently urging it past center, so that it will be stably retained by the internal switch 30 mechanism in the alternate state.

Figure 3B:
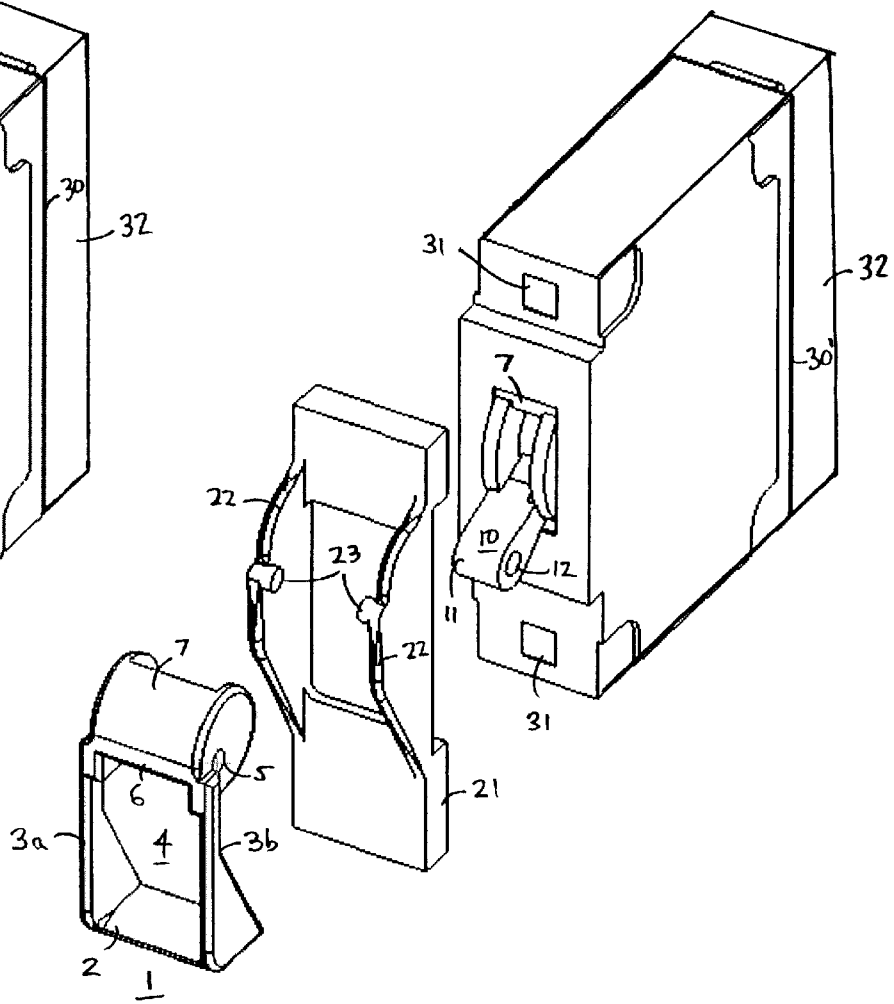
FIGS. 3A and 3B show exploded side perspective views of a first and second embodiment according to the present invention.
Figure 3A:
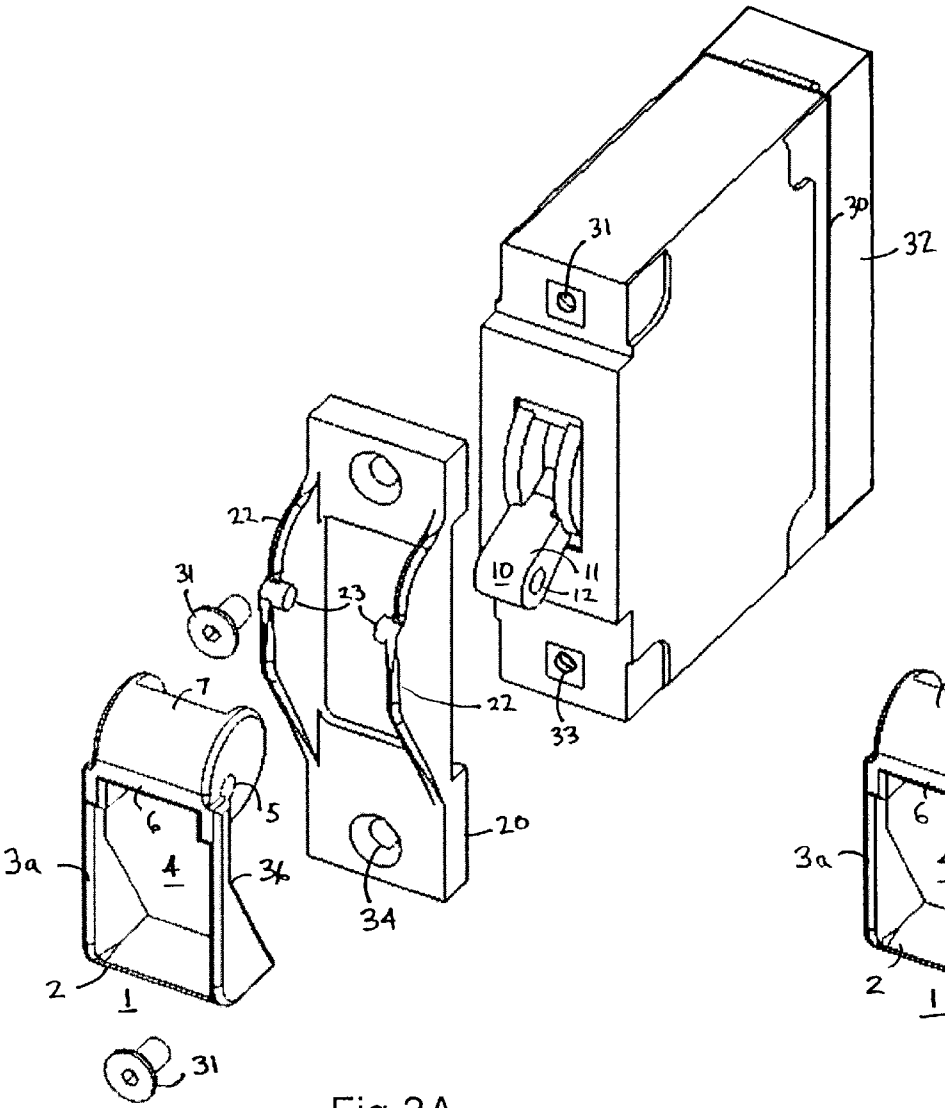
Figure 4B:
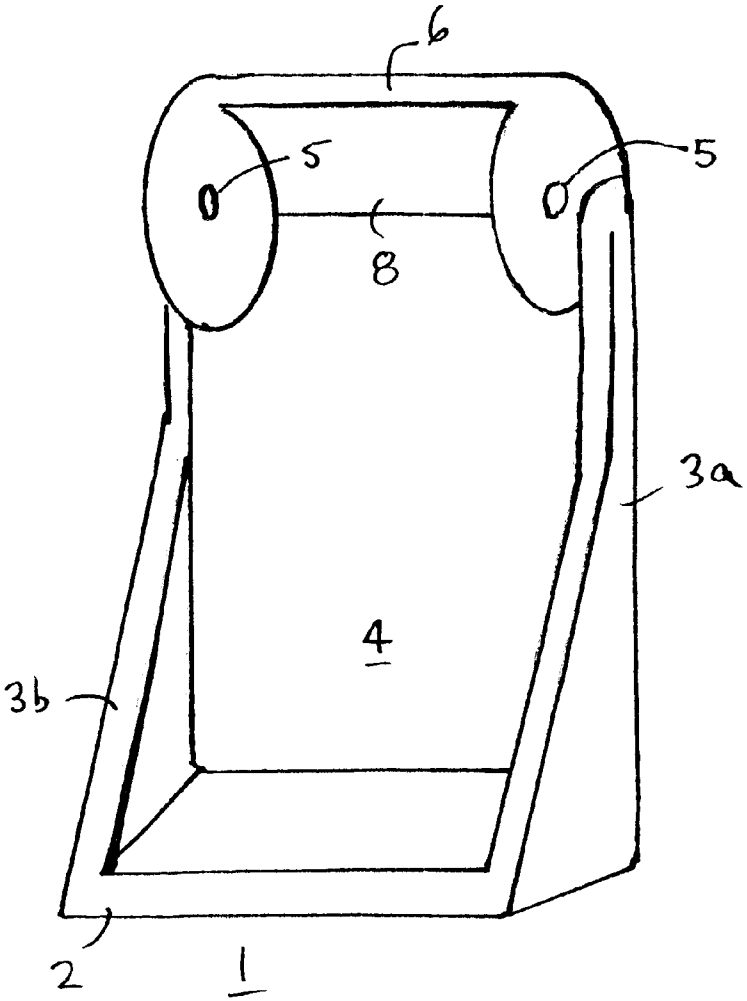
FIGS. 4A and 4B show, respectively, rear perspective views of the switch guard and the extraction handle of FIG. 3A.
Figure 4A:
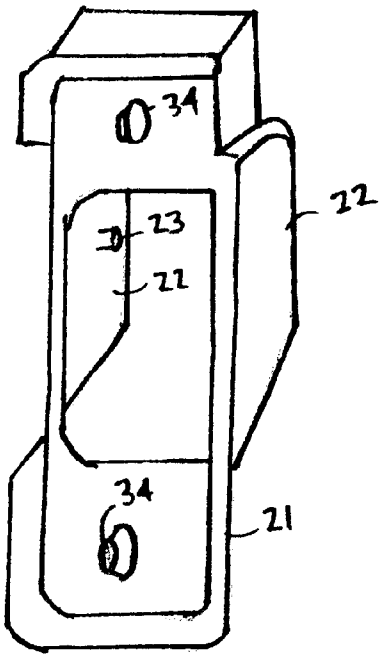
Figure 6:
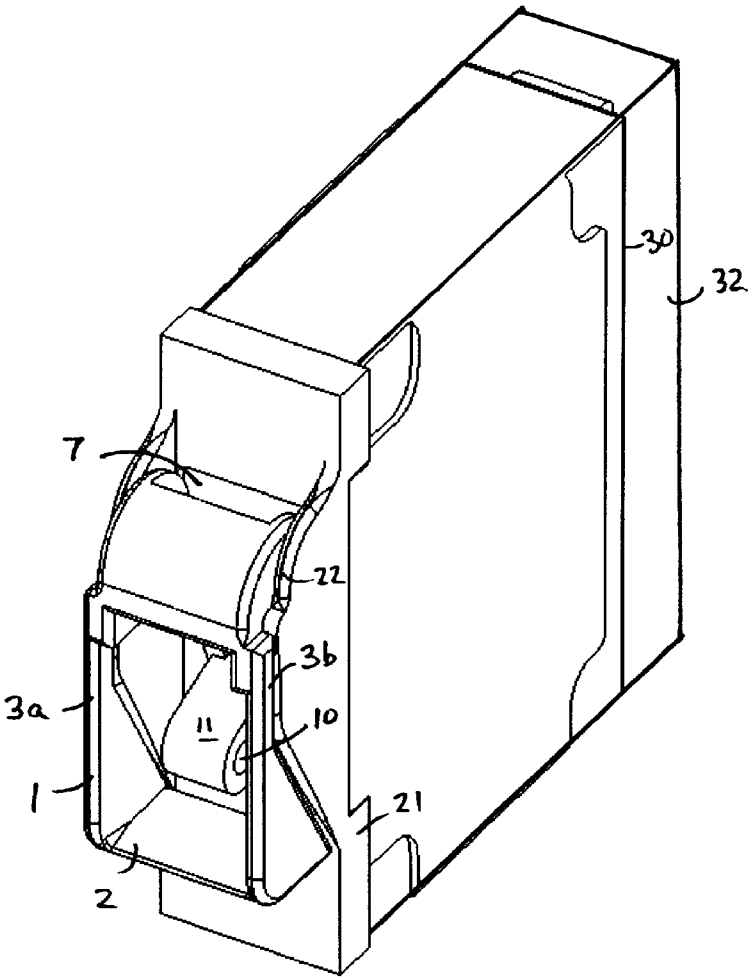
FIGS. 5, 6, 7, and 8 show front perspective views of the embodiments of FIGS. 3A and 3B in the normal position and the extraction position, respectively.
Figure 5:
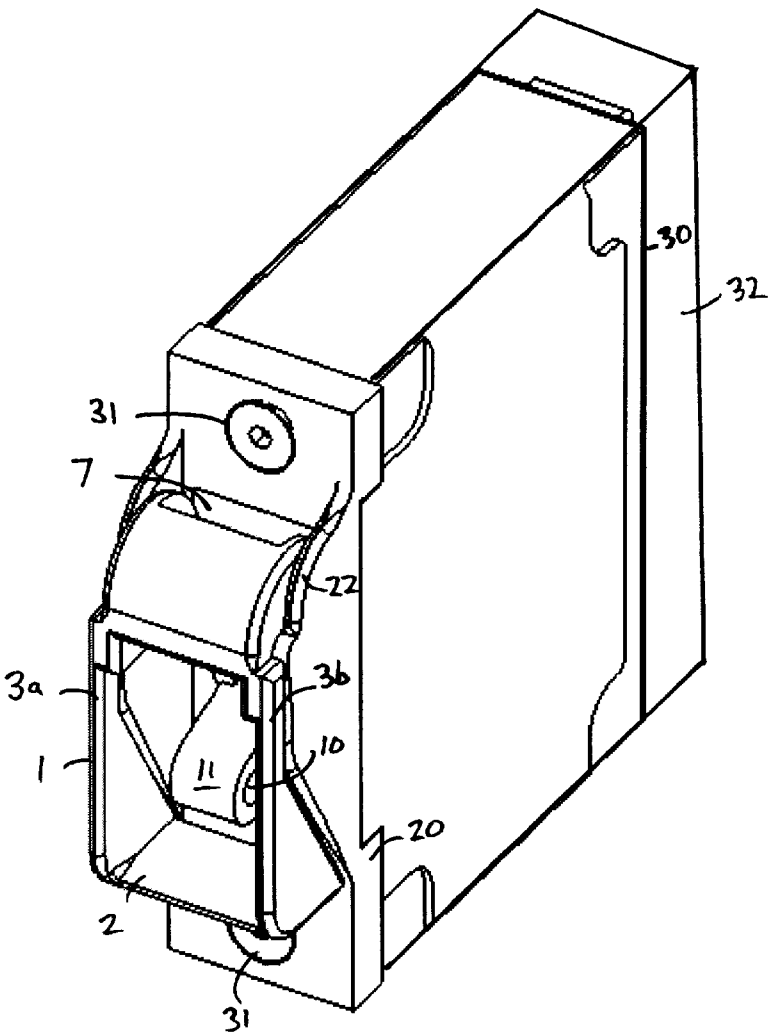
Figure 8:
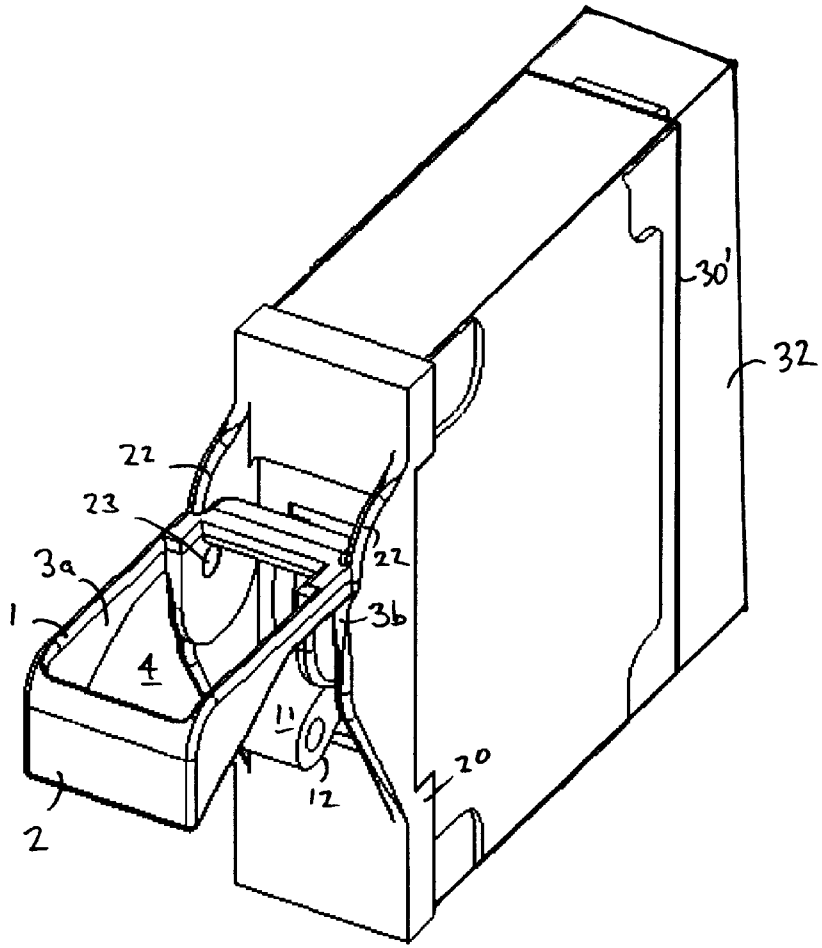
Figure 7:
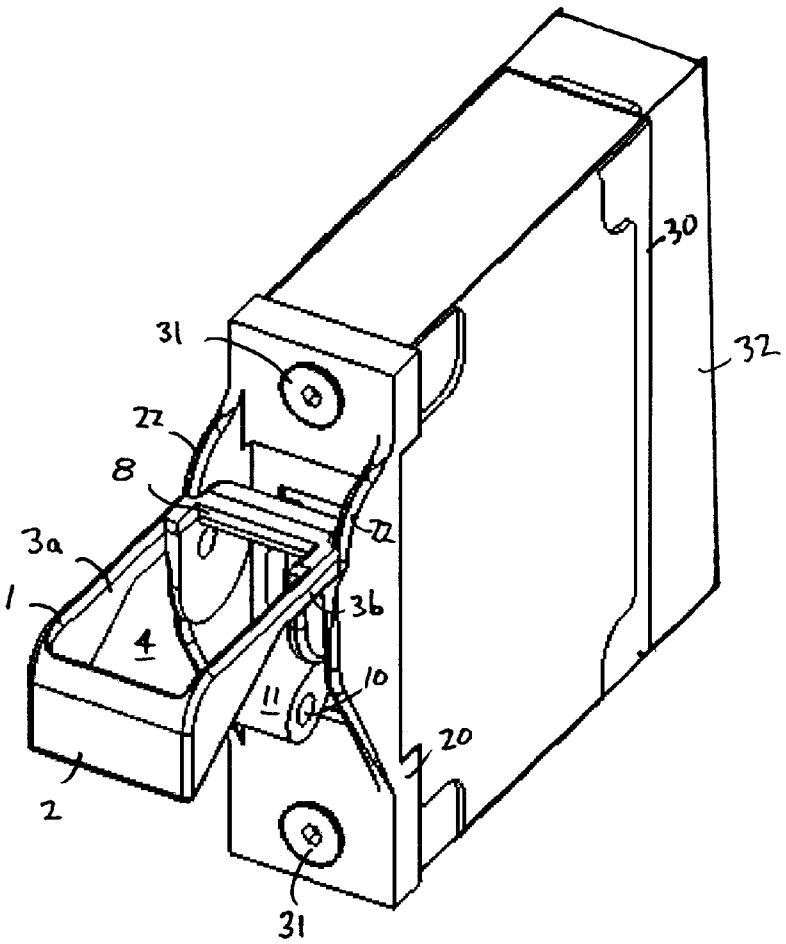

The extraction handle 1 is mounted in a switch guard 20 or 21, shown in FIGS. 3A and 3B, respectively (depending on whether field installed or factory installed), having a pair of lateral surfaces 22 which are adapted to surround the switch lever handle 10 on either lateral side, on which the fulcrum pins 23 are formed or provided. The extraction handle 1 is mounted on the fulcrum pins 23, between the lateral surfaces 22, generally by a process of elastic deformation. The switch guard 20 of the first embodiment, in turn, is mounted to the switch 30 body, for example, by means of a threaded fastener 31 which cooperates with a helically threaded recess (not shown) in the switch 30. Alternately, the switch guard 21 of the second embodiment may be an integral part of the front of the switch 30 body. Other fastening methods and means may be employed, without altering the essential nature of the invention.

When a tensile force is applied to the extraction handle 1, initially the edge portion 6 pushes against the side 11 of the switch handle lever 10, forcing the switch 30 mechanism into the deactivated state. (The deactivated state, as referred to herein, is that state in which is it desired to emplace the switch prior to extraction from its mounting panel or socket; often, in a single pole switch, this will be the OFF state).

Further traction on the extraction handle 1 dislodges the switch 30 body from its mounting socket 31, allowing removal or replacement of the switch 30 body while ensuring that the switch mechanism is in a desired mode of operation or state.

The aperture 4 between the elongated side arms 3*a*, 3*b* allows the switch 30 mechanism to be changed from the deactivated state to the activated state, using, for example, a finger or tool, which is inserted into the aperture 4 to press against the other side 12 of the switch handle lever 10 to alter the switch 30 mechanism state.

The extraction handle 1 and switch guard 20 or 21 are preferably formed of a high strength polymer, and, example, may be reinforced with fiber glass. While metals or other materials may be used, conductive materials are generally avoided in manual interfaces of high voltage electrical switching apparatus. The materials should have sufficient strength and rigidity for the intended purpose, and be relatively impact, environment, and heat resistant. Preferably, the material is sufficiently elastic to allow installation of the handle 1 over the fulcrum pins 23

The extraction handle 1 and switch guard 20 or 21 are preferable formed by an injection molding process, however, the production process is generally non-critical, and therefore other processes may be acceptable, for example machining.

In order to assemble the extraction handle 1 with the switch guard 20 or 21, the lateral surfaces 22 are elastically spread, and the side walls of handle 1 near the fulcrum pin recesses 5 sufficient to allow the elongated side arms 3*a*, 3*b* to be inserted therebetween. The extraction handle 1 is then positioned to allow the fulcrum pins 23 to rest inside the fulcrum pin recesses 5, allowing the switch guard lateral surfaces 22 to return to their normal position, while retaining the extraction handle 1 in place. It is also possible to provide slotted grooves in the sides of the handle, permitting the handle to be installed from the rear of the switch guard 20, 21 when the guard is separate from the switch 30, but which retains the handle when the switch guard 20, 21 is installed on the switch 30.

The switch 30 and switch socket 31 are of known type, and particular selection thereof are generally not critical to the design and implementation of the switch guard of the present invention. However, it is noted that, in instances where the extraction force of the switch socket is large, or the switch non-standard, the present invention may be modified in known manner to achieve its intended purpose.

The term "comprising", as used herein, shall be interpreted as including, but not limited to inclusion of other elements not inconsistent with the structures and/or functions of the other elements recited.

The invention may be embodied in other specific forms without departing from the spirit or essential characteristics thereof. The present embodiments are, therefore, to be considered in all respects as illustrative and not restrictive, the scope of the invention being indicated by the appended claims rather than by the foregoing description, and all changes which come within the meaning and range of equivalency of the claims are, therefore, intended to be embraced therein.

What is claimed is:

1. A switch protector, for a switch having a lever having first and second states, comprising:

(a) a switch guard, adapted to be situated proximate to and around said lever; and (b) an extraction handle, displaceably mounted on said switch guard, having a first position and a second position, being adapted to apply a tensile force on said switch guard, for extracting the switch from a socket when in said second position, said extraction handle in said first position, blocking manual access to the lever in the first state, and when displaced from said first position to said second position, displacing the lever from the first position to the second position.

2. The switch protector according to claim 1, wherein said extraction handle pivots about a mounting axis on said switch guard, and wherein said extraction handle comprises a surface spaced from said mounting axis for applying a force to said lever when said extraction handle is rotated about said mounting axis.

3. The switch protector according to claim 1, wherein said extraction handle comprises an aperture adapted to allow insertion of a fmger therethrough for manually displacing the lever.

4. The switch protector according to claim 1, wherein said switch guard comprises a pair of lateral guard surfaces, each having thereon a pivot for rotatably mounting said extraction handle.

5. The switch protector according to claim 1, wherein said extraction handle comprises a cam surface and a leading edge, wherein during a displacement of said extraction handle from said first position to said second position, said leading edge initially, followed by said cam surface, contacts the lever.

6. A switch, having a mechanical user interface and an electrical socket interface, the user interface comprising a lever handle and the electrical interface comprising a set of contacts separable upon application of tension, the improvement comprising:

(a) a handle guard; and (b) an extraction tool, adapted to apply sufficient tension to the switch to separate the contacts from the electrical socket;

wherein the extraction tool has a first position and a second position, said extraction tool being adapted, upon application of tension when in said first position, to move the lever handle of the switch from an active to an inactive position before assuming said second position, and upon application of tension when in said second position to separate the set of contacts from the electrical socket.

7. The switch according to claim 6, wherein said extraction tool pivots about a mounting axis on said handle guard, and wherein said extraction tool comprises a surface spaced from said mounting axis, for applying a force to said lever handle when said extraction tool is rotated about said mounting axis.

8. The switch according to claim 6, wherein said extraction tool comprises an aperture adapted to allow insertion of a finger therethrough for manually displacing the lever handle.

9. The switch according to claim 6, wherein said handle guard comprises a pair of lateral guard surfaces, each having thereon a pivot for rotatably mounting said extraction tool.

10. The switch according to claim 6, wherein said extraction tool comprises a cam surface and a leading edge, wherein during a displacement of said extraction tool from said first position to said second position, said leading edge initially, followed by said cam surface, contacts the lever handle.

11. A retrofit kit for a socketed electrical switch having an actuation lever, comprising:

(a) an actuation lever guard, adapted for attachment to the electrical switch and being adapted to restrict manual access to the actuation lever; and (b) an extraction tool, mounted on said actuation lever guard adapted to. apply sufficient tension to the switch to separate the contacts from the electrical socket;

wherein the extraction tool has a first position and a second position, said extraction tool being adapted, upon application of tension when in said first position, to move the lever handle of the switch from an active to an inactive position before assuming said second position, and upon application of tension when in said second position to separate the set of contacts from the electrical socket.

12. The retrofit kit according to claim 11, wherein said lever guard comprises a pair of guard plates, having pivots thereon for mounting said extraction tool, said extraction tool pivoting about a mounting axis defined by said pivots on said actuation switch guard, and wherein said extraction tool comprises a cam surface and a leading edge spaced from said mounting axis for applying a force, initially by said leading edge, and then by said cam surface, to said lever handle when said extraction tool is rotated about said mounting axis, said extraction tool comprising an aperture adapted to allow insertion of a finger therethrough for manually displacing the lever handle.

13. A method for removing a switch from a socket, comprising the steps of:

(a) providing a switch, having a mechanical user interface and an electrical socket interface, the user interface comprising a lever handle and the electrical interface comprising a set of contacts separable upon application of tension;

(b) providing an extraction member, having first and second positions, adapted to apply sufficient tension to the switch to separate the contacts from the electrical socket, and being disposed to shift the lever handle from an active position to an inactive position when displaced from a first position to a second position;

(c) applying a first tension to the extraction member while in the first position to move the lever handle of the switch from the active to the inactive position; and (d) applying a second tension, when the extraction member is in the second position, to separate the set of contacts from the electrical socket.

14. The method according to claim 13, wherein said extraction member comprises:

(a) an actuation lever guard, adapted for attachment to the electrical switch and being adapted to restrict manual access to the actuation lever; and (b) an extraction tool, mounted on said actuation lever guard adapted to apply sufficient tension to the switch to separate the contacts from the electrical socket.

15. The method according to claim 14, wherein said actuation lever guard comprises a pair of guard plates, having pivots thereon for mounting said extraction tool, said extraction tool pivoting about a mounting axis defined by said pivots on said actuation switch guard, and wherein said extraction tool comprises a cam surface and a leading edge spaced from said mounting axis for applying a force, initially by said leading edge, and then by said cam surface, to said lever handle when said extraction tool is rotated about said mounting axis, said extraction tool comprising an aperture adapted to allow insertion of a finger therethrough for manually displacing the lever handle.

* * * * *